US008726474B2

(12) United States Patent
Simmen et al.

(10) Patent No.: US 8,726,474 B2
(45) Date of Patent: May 20, 2014

(54) TEXTURING DEVICE AND METHOD FOR TEXTURING CONTINUOUS YARNS

(75) Inventors: Christian Simmen, Wattwil (CH); Gotthilf Bertsch, Ebnat-Kappel (CH); Kurt Klesel, Heiden (CH)

(73) Assignee: Oerlikon Heberlein Temco Wattwil AG

( * ) Notice: Subject to any disclaimer, the term of this patent is extended or adjusted under 35 U.S.C. 154(b) by 321 days.

(21) Appl. No.: 13/146,313

(22) PCT Filed: Jan. 19, 2010

(86) PCT No.: PCT/EP2010/050584

§ 371 (c)(1),
(2), (4) Date: Jul. 26, 2011

(87) PCT Pub. No.: WO2010/086258

PCT Pub. Date: Aug. 5, 2010

(65) Prior Publication Data

US 2011/0277285 A1 Nov. 17, 2011

(30) Foreign Application Priority Data

Jan. 30, 2009 (EP) ..... 09151762

(51) Int. Cl.
*D02J 1/08* (2006.01)
*D02G 1/16* (2006.01)

(52) U.S. Cl.
USPC ..... 28/271; 28/272; 28/276

(58) Field of Classification Search
USPC ..... 28/271, 272, 273, 274, 276, 254, 275, 28/257; 57/908, 350, 333, 289
See application file for complete search history.

(56) References Cited

U.S. PATENT DOCUMENTS

| | | | | |
|---|---|---|---|---|
| 3,251,181 | A * | 5/1966 | Breen | 428/369 |
| 3,389,444 | A | 6/1968 | Fletcher et al. | |
| 3,483,691 | A | 12/1969 | Williams et al. | |
| 3,545,057 | A * | 12/1970 | Lubach | 28/273 |
| 3,577,614 | A * | 5/1971 | Price | 28/272 |

(Continued)

FOREIGN PATENT DOCUMENTS

| | | |
|---|---|---|
| CA | 1064687 | 10/1979 |
| DE | 3201055 | 9/1982 |

(Continued)

*Primary Examiner* — Amy Vanatta
(74) *Attorney, Agent, or Firm* — Shoemaker and Mattare

(57) ABSTRACT

The invention relates to a texturing device (1) for texturing at least one continuous yarn consisting of a plurality of filaments. This texturing device (1) has at least one housing (10) and at least one nozzle core (20), which can be charged with a fluid. The nozzle core (20) includes a yarn channel (21) and at least one fluid feed channel (22), opening into the yarn channel with a radial component. Furthermore, the nozzle core (20) includes an outlet region (23) of the yarn channel (21) and an inlet region (24) with an inlet opening (25) of the yarn channel (21). The distance between the inlet opening (25) of the inlet region (24) and the fluid feed channel (22) of the nozzle core (20) opening into the yarn channel (21) is at most 12.5 mm. The region (11), which is located ahead of the inlet region (24) of the nozzle core (20) in the direction of filament movement, has a radial outer delimiting area (12). This lies outside a cone of 20° narrowing in the direction of filament movement. The outer delimiting area (12) preferably lies outside a cone of 30°.

22 Claims, 13 Drawing Sheets

(56) References Cited

U.S. PATENT DOCUMENTS

Figure 1A:
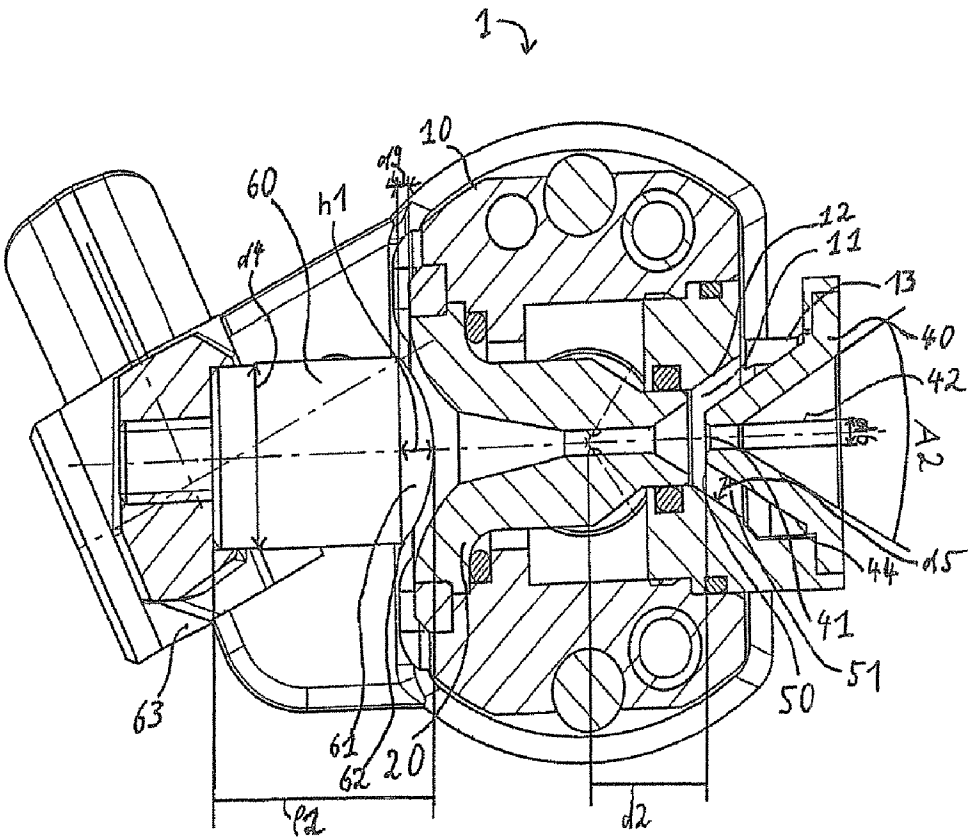

| | | | | |
|---|---|---|---|---|
| 4,004,329 | A * | 1/1977 | London et al. | 28/274 |
| 4,095,320 | A * | 6/1978 | Polney | 28/273 |
| 4,141,122 | A * | 2/1979 | Trifunovic | 28/271 |
| 4,157,605 | A * | 6/1979 | Agers | 28/254 |
| 4,507,833 | A * | 4/1985 | Simmen | 28/254 |
| 5,326,009 | A * | 7/1994 | Kobayashi et al. | 226/97.4 |
| 6,088,892 | A * | 7/2000 | Bertsch et al. | 28/273 |
| 7,752,723 | B2 * | 7/2010 | Bertsch | 28/271 |
| 2003/0030191 | A1 * | 2/2003 | Davis et al. | 264/555 |
| 2006/0064859 | A1 * | 3/2006 | Bertsch et al. | 28/271 |

FOREIGN PATENT DOCUMENTS

| | | |
|---|---|---|
| EP | 088254 | 4/1988 |
| EP | 880611 | 12/1988 |
| EP | 1010788 | 6/2000 |
| EP | 1818433 | 8/2007 |
| GB | 1225020 | 3/1971 |
| GB | 2306176 | 4/1997 |
| WO | 97/30200 | 8/1997 |
| WO | 2004/085722 | 10/2004 |
| WO | 2004/106605 | 12/2004 |

* cited by examiner

- Higher yarn tension allows higher speed and/or higher delivery
- Fewer events/100 m = more uniform yarn
- Quality = visual judgement of yarn and knit

Comparison: Prior art - short nozzle

PA66 dtex 78f51x2 glzd. C/E

TEXTURING DEVICE AND METHOD FOR TEXTURING CONTINUOUS YARNS

The invention relates to a texturing device and to a method for texturing at least one continuous yarn composed of a plurality of filaments, having the features of the preamble of the independent patent claims.

For texturing a continuous yarn composed of a plurality of filaments, nowadays nozzles are preferably used which can be fed with a fluid, the fluid used preferably being air. Texturing of a continuous yarn is understood here and hereafter to mean the production of nooses and loops on the continuous yarn, the yarn being shortened during this process.

EP 0 088 254 A2 describes a texturing device for airblast texturing, with a yarn duct having an outlet orifice opening convexly outward. The outlet orifice possesses a diameter which amounts to at least 4 times the diameter of the yarn duct. Arranged adjacently to the outlet orifice is a spherical or hemispherical baffle body which forms with the outlet orifice an annular gap. The baffle body has at most double the diameter of the outlet orifice.

EP 0 880 611 A1 describes a texturing device for airblast texturing having a continuous yarn duct. An exit region of the yarn duct of the nozzle core is designed as a supersonic tunnel. The air supplied via a compressed air bore is accelerated to a velocity of more than Mach 2. Here, too, a spherical baffle body is arranged adjacently to the outlet orifice.

WO 2004/085722 A1 describes a texturing device for airblast texturing, having an exit region which is designed correspondingly to EP 0 880 611 as a supersonic tunnel. The air is supplied here via at least one compressed air bore at an angle of 48° to 80° with respect to the axis of the yarn duct. Here, too, a spherical baffle body is arranged in the region of the outlet orifice.

WO 2004/106605 A1 describes a texturing device for airblast texturing, which is formed from a ceramic nozzle core of approximately constant wall thickness and from a housing. The ceramic nozzle core fulfills the central texturing functions and the assembled texturing device has external dimensions which conform to the prior art and thus allow it to be used as an interchangeable core. This division into a nozzle core and a housing results in lower production costs for the texturing device.

These previously known texturing devices have led in each case to improvements in the texturing quality of continuous yarns by increasing the production speed or to reduced production costs for the texturing device. However, the results achieved by these do not always satisfy present-day requirements with regard to production speed, quality, delivery, susceptibility of the nozzle core to soiling, robustness of assembly and handling of the texturing device during production.

An object of the present invention, therefore, is to avoid the disadvantages of the known prior art, that is to say, in particular, to develop a texturing device and a method, by means of which, in the texturing of continuous yarns, the production speed can be increased, the soiling of the texturing device during production can be reduced and handling during production can be simplified.

These objects are achieved by means of a novel texturing device and its use in texturing methods according to the independent claims.

The embodiment according to the invention relates to a texturing device for texturing at least one continuous yarn composed of a plurality of filaments. This texturing device has at least one housing and at least one nozzle core which can be fed with a fluid. The housing and nozzle core are of multi-part design. It is therefore possible to combine different nozzle cores as interchangeable cores with the housing. The nozzle core contains a yarn duct and at least one fluid supply duct issuing with a radial component into the yarn duct. A fluid supply duct issuing with a radial component into the yarn duct is understood hereinafter to mean that the angle between the supply axis and the axis of the yarn duct is greater than 0° and smaller than 90°.

Furthermore, the nozzle core contains an exit region of the yarn duct, which exit region may widen, for example, in the thread movement direction, and an entry region with an inlet orifice of the yarn duct. The exit region and entry region of the nozzle core are understood here and hereafter to mean the regions of entry and exit of the thread during the intended use. The distance between the inlet orifice of the entry region and the fluid supply duct, issuing into the yarn duct, of the nozzle core amounts to at most 12.5 mm. The position of the inlet orifice of the fluid supply duct into the yarn duct is defined such that the farthest point of this inlet orifice from the inlet orifice of the entry region is taken as a reference.

The region which is located upstream of the entry region of the nozzle core in the thread movement direction has a radial outer periphery. This lies outside a cone of 20° narrowing in the thread movement direction. The outer periphery preferably lies outside a cone of 30°. This means, in other words, that no elements of the nozzle core or of a housing carrying the nozzle core lie inside the imaginary conical surface.

The imaginary conical surface possesses, at the inlet orifice of the nozzle core, a radius at least equal to that of the inlet orifice.

The advantage of the nozzle core being shorter, as compared with the prior art, is a higher possible delivery of the filaments into the texturing device. A higher delivery of the filaments has the advantage that it is possible to produce thicker continuous yarns. A further advantage of this embodiment is a higher achievable production speed, with the quality remaining the same.

The region which is located upstream of the entry region of the nozzle core in the thread movement direction has an extent parallel to the axis of the yarn duct of at most 5 mm. The region preferably has an extent of at most 4 mm and especially preferably of at most 3 mm.

This means that, for example, elements of the nozzle core or of a housing carrying the nozzle core which project a greater distance into the imaginary cone do not come under the scope of protection.

A nozzle core according to the invention of the texturing device may be of one-part design. However, the nozzle core according to the invention of the texturing device may also be of two-part design, as, for example, in what is known as the SlideJet type of construction according to EP 1 618 236 B1. A nozzle core of this type may, for example, have an essentially rectangular yarn duct cross section in the region in which the fluid supply duct issues into the yarn duct. The two-part nozzle core may, for example, have an open position for threading-in and a closing position for operating the device.

A fluid supply duct issuing with a radial component into such a yarn duct of essentially rectangular cross section has an angle of greater than 0° and smaller than 180°, preferably of between 30° and 150°, especially preferably of between 45° and 90° and most especially preferably of between 48° and 80° between the yarn duct axis and the fluid supply duct axis. Here, for example, an angle of 45° means that a fluid with which the yarn duct can be fed via the fluid supply duct has a flow velocity component of the average flow parallel to the thread movement direction.

Moreover, it was found, surprisingly, that the texturing device according to the invention in one-part or two-part form is suitable for use in false twine texturing, this also being designated as false twisting. In this process, in an intermingling step in the nozzle core the continuous yarn composed of a plurality of filaments is intermingled, so that cohesion between the filaments is created without substantial knot formation between the filaments being necessary to hold them together. A preferred embodiment contains a nozzle core with an essentially cylindrical region with a length of at most 6 mm between the inlet orifice of the cylindrical region and the inlet orifice of the fluid supply duct issuing into the yarn duct. The entire region which is situated upstream of the cylindrical region of the nozzle core in the thread movement direction has a radial outer periphery which lies outside a cone of 20° narrowing in the thread movement direction. The outer periphery preferably lies outside a cone of 30°.

The cylindrical region which is shorter, as compared with the prior art, likewise has a beneficial effect upon the possible delivery of the filaments into the texturing device and upon the achievable production speed. Moreover, the yarn quality of the continuous yarn rises after the texturing process, that is to say the loops formed on the continuous yarn as a result of the texturing process vary in length to a lesser extent. Furthermore, the general appearance of the continuous yarn is improved, this being used in order to judge the quality.

An especially preferred embodiment comprises a nozzle core with a yarn duct which narrows in the thread movement direction in the entry region. This narrowing is preferably conical and forms an opening angle of between 30° and 120°.

As a result of this structural refinement, a further increase in delivery is achieved, and also a higher production speed, while at the same time the yarn quality of the continuous yarn is improved.

A further preferred embodiment of the invention comprises an additional thread guide for guiding the filaments which is arranged upstream of the inlet orifice of the nozzle core in the thread movement direction.

A thread guide is understood hereafter to mean a device which introduces the filaments of the continuous yarn into the yarn duct of the nozzle core in a predetermined way according to the structural configuration of the thread guide.

Such an arrangement allows adjustability in the supply of the endless yarn into the yarn duct of the nozzle core for optimal texturing results for different yarns. This may be achieved, for example, by means of differently shaped thread guides or the type of mounting of the thread guide in front of the nozzle core. The different variants may, for example, be coordinated in each case with different yarn types or different production speeds.

In a further advantageous embodiment, a thread guide exit and the inlet orifice of the fluid supply duct are spaced apart from one another.

The distance to a thread guide exit is defined by a plane which runs through that point of the thread guide lying nearest to the nozzle core, as seen in the thread movement direction, and which stands essentially perpendicularly to the axis of the yarn duct.

It was shown that the spaced-apart mounting of the thread guide reduces soiling in the yarn duct. This soiling occurs, for example, due to the abrasion of the filaments when these are guided in the thread guide or the nozzle core and in this case are in contact with the thread guide or the nozzle core. By the thread guide being used, contact of the filaments with the nozzle core and therefore also soiling of the yarn duct are reduced. This leads to a longer service life of the texturing device in production.

A further advantage of spaced-apart mounting is that an orifice, which can act as a backflow orifice, is formed between the thread guide and nozzle core. It was shown, unexpectedly, that it is especially advantageous that such an orifice occurs in the region of the inlet orifice of the nozzle core. Tests have shown that a flow with the component in the thread movement direction and a flow with an opposite component are present in the yarn duct of the nozzle core. This backflow orifice takes up part of the flow having an opposite component, thus leading to lower flow resistance for the filaments. These are therefore braked to a lesser extent. This results in possible higher delivery and in a higher yarn quality.

This positive influence of the discharge of at least part of the backflow through an additional backflow orifice is surprising. In "Synthetic Filament Yarn: Texturing Technology" by Ali Demir (ISBN 0-13-440025-9), it is explained on page 233 that the backflow air has no effect upon the texturing process. In the article "Fluid Simulation of the Airflow in Texturing Jets" by Syang-Peng Rwei and Hsin-I Pai, published in the Textile Research Journal, this opinion is backed up by the view that this backflow has only a loosening effect upon the filaments.

The distance of the thread guide is selectable, for example, by the choice of differently dimensioned thread guides, so that a predetermined distance is set during mounting. A further possibility is to use an adjustable thread guide, so that the distance can be set according to requirements.

In a further preferred embodiment, the distance between the thread guide exit and the inlet orifice of the fluid supply duct preferably amounts to at most 14 mm.

Also preferably, the thread guide has a yarn duct which narrows in the thread movement direction from the diameter of the inlet orifice of the thread guide to an eye diameter of the thread guide.

There is the advantage that the backflow can be influenced significantly by a possible choice of different thread guides with different eye diameters. This affords the benefits described above.

It is preferable further that the narrowing of the yarn duct of the thread guide is conical and forms an angle of between 30° and 120°.

Advantageously, the thread guide is arranged in such a way that the orifice between the thread guide and the housing with the nozzle core is designed in the entry region as a gap.

This gap may, for example, be designed structurally such that the entry region of the nozzle core and/or of the housing narrows conically and that the thread guide is inserted partially in the entry region of the nozzle core and/or of the housing. Furthermore, at least the outer shape of that part of the thread guide which is located in the entry region of the nozzle core and/or of the housing narrows conically. A gap is thereby formed in the entry region between the thread guide and the nozzle core and/or the housing. The outer shape of the thread guide in this region runs, in particular, essentially approximately parallel to the conically narrowing entry region of the housing, so that an annular gap is formed.

The annular gap occurring as a result of this design has the advantage that the backflow can be taken up effectively for optimal texturing results. The annular gap may possibly be interrupted, essentially parallel to the flow direction, by webs. By the appropriate choice of the conicity of the thread guide and entry region of the nozzle core and/or of the housing, a tapering or widening gap may also be formed, as required. This structural refinement makes it possible to adapt the texturing device optimally for different flow conditions in the nozzle core when different fluids and/or different pressures at which the nozzle core can be fed are used.

The eye diameter of the thread guide is typically smaller than the smallest diameter of the yarn duct of the nozzle core.

The nozzle core and housing are preferably designed such that the nozzle core can be connected interchangeably to the housing.

This may be achieved, for example, in that the nozzle core can be integrated in a screw-on housing, so that it is possible to change between different nozzle cores having a different structural configuration.

Alternatively, the nozzle core and housing are designed such that the nozzle core is not connectable interchangeably to the housing 10.

This structural refinement may be implemented, for example, in that the nozzle core is pressed or glued into the housing and is connected to the latter such that the nozzle core can no longer be separated from the housing.

The advantage of this is that possible operating errors caused when the texturing device is being used by the choice of a nozzle core which is not suitable for the application can be ruled out. The non-interchangeable connection of the nozzle core and housing thus affords increased safety against operating errors.

A further aspect of the invention relates to a texturing device for texturing at least one continuous yarn composed of a plurality of filaments. This texturing device contains at least one yarn duct, into which at least one fluid supply duct issues with a radial component. Moreover, this texturing device contains an exit region of the yarn duct and an entry region of the yarn duct. According to the invention, the texturing device contains at least one backflow orifice for taking up part of a flow having a component opposite to the thread movement direction. The distance of the backflow orifice from the inlet orifice of the fluid supply duct with a radial component preferably amounts to at most 14 mm.

The position of the backflow orifice in the yarn duct is defined such that the nearest point of this backflow orifice from the inlet orifice of the texturing device is taken as a reference.

The backflow orifice of a backflow duct is located, in the thread movement direction, between the inlet orifice of the texturing device and the inlet orifice of the fluid supply duct into the yarn duct. This structural refinement has the advantage that the flow with a component opposite to the thread movement direction is divided into a part flowing through the eye diameter of the thread guide and a part discharged through the backflow orifice.

The number of backflow orifices may be selected according to the application with regard to the fluid to be used and to the pressure of the fluid with which the texturing device can be fed. The cross-sectional area of the backflow orifices is, overall, greater than the cross-sectional area of the yarn duct of the texturing device at the narrowest point. Cross-sectional area is understood here to mean a section along a plane which stands perpendicularly to the axis along the backflow orifice. The individual distance of the backflow orifice from the inlet orifice may likewise be selected according to the application. The angle between the axis of the backflow duct and the axis of the yarn duct points opposite to the thread movement direction and, in particular, preferably lies between 15° and 80°.

As already described above, this backflow orifice takes up part of the flow having an opposite component, thus leading to a lower flow resistance for the filaments. These are therefore braked to a lesser extent. This results in possible higher delivery and a higher yarn quality.

A preferred embodiment has a backflow orifice, the cross-sectional area of which is at least larger than the cross-sectional area of the yarn duct at the point of smallest diameter.

The cross-sectional area of the yarn duct at the point of smallest diameter is understood to mean a section along a plane perpendicular to the axis of the yarn duct.

Yet a further aspect of the invention relates to a texturing device for texturing at least one continuous yarn composed of a plurality of filaments. This texturing device contains at least one nozzle core capable of being fed with a fluid. Furthermore, this texturing device contains at least one yarn duct having at least one fluid supply duct issuing with the radial component into the yarn duct. Moreover, the texturing device contains an exit region of the yarn duct and an entry region of the yarn duct. Further, a baffle body for the exit-side delimitation of the yarn duct is contained. According to the invention, the baffle body, on the side facing the nozzle core, possesses the form of a spherical cap. This is smaller than a hemisphere. The baffle body, on the side facing away from the nozzle core, possesses, after the spherical cap, a discontinuous transition.

A spherical cap is understood to mean a spherical segment which occurs as a result of a plane section through a sphere. For the baffle body, a spherical segment is used, the height of which is smaller than the original radius of the sphere from which the spherical cap has been produced. The height of the spherical cap is defined as the length of a straight line which stands perpendicularly on the center point of the sectional plane and which touches the spherical segment surface. This perpendicularly standing straight line is oriented essentially parallel to the axis of the yarn duct when the baffle body is in an operating position.

The discontinuous transition arises in that a further part of the baffle body which may serve for holding the baffle body is constructed such that an edge is formed.

Especially preferably, the discontinuous transition forms a breakaway edge of the baffle body.

The advantage of the breakaway edge is that the flow conditions in the nozzle exit are changed, so that the texturing device is less susceptible to soiling. This results in the beneficial effect of longer intervals between operations necessary for cleaning the texturing device, with the result that handling during production is reduced.

Also preferably, the breakaway edge is at a distance of between 0 mm and 2 mm from a plane defined by the outlet orifice.

This adjustable distance has the advantage that, by the choice of the suitable distance for a combination of the yarn, fluid and pressure of the fluid with which the texturing device can be fed, the susceptibility of the texturing device to soiling can be minimized.

Also preferably, the texturing device comprises a set of at least two nozzle cores of different lengths which can be received by the housing for the purpose of setting the distance of the breakaway edge from the plane defined by the outlet orifice.

This embodiment for setting the distance has the advantage of avoiding operating errors and of the possibility for a more robust construction of the holder of the baffle body, as compared with an embodiment according to the prior art with a variably adjustable distance of the baffle body.

Especially preferably, the largest diameter of the baffle body is at least equal to 0.5 times the diameter of the outlet orifice.

The invention relates, further, to a method for texturing at least one continuous yarn composed of a plurality of filaments by means of a texturing device. This method involves the steps the supply of a continuous yarn via an entry region into a yarn duct of the nozzle core, the feeding of the texturing device with a fluid via at least one fluid supply duct issuing with a radial component into the yarn duct, and the discharge of the textured yarn at its exit region.

The continuous yarn is first led through a region of the texturing device having a radial outer periphery which lies outside a cone of 20° narrowing in the thread movement direction. This outer periphery preferably lies outside a cone of 30°. The continuous yarn is subsequently led through a region of the yarn duct of the nozzle core with a length of at most 12.5 mm. This is the distance between the inlet orifice of the nozzle core and the inlet orifice of the fluid supply duct into the yarn duct.

This method may preferably be carried out by means of the above-described texturing device according to claims 1 to 10.

Alternatively, the invention relates to a method for texturing at least one continuous yarn composed of a plurality of filaments by means of a texturing device. This method comprises the steps the supply of a continuous yarn via an entry region to a yarn duct of the nozzle core, the feeding of the texturing device with a fluid via at least one fluid supply duct issuing with a radial component into the yarn duct, and the discharge of the textured yarn at its exit region.

The fluid flow is divided in the yarn duct of the nozzle body into a fluid flow with a component in the thread movement direction and into a fluid flow with a component opposite to the thread movement direction. The fluid flow with an opposite component is discharged at least partially through a backflow orifice with a radial component which is located upstream of the fluid supply duct in the thread movement direction. In particular, the distance between the inlet orifice of the fluid supply duct and the backflow orifice amounts to at most 14 mm.

This method is preferably applied with aspects of the above-described invention according to claims 11 and 12.

The invention relates, furthermore, to a method for texturing at least one continuous yarn composed of a plurality of filaments by means of a texturing device. The method according to the invention involves the steps the supply of a continuous yarn via an entry region to a yarn duct of the nozzle core, the feeding of the texturing device with a fluid via at least one fluid supply duct issuing with a radial component into the yarn duct, and the discharge of the textured yarn at its exit region which is delimited by a baffle body.

The textured continuous yarn is discharged via the baffle body which, on the side facing the nozzle core, possesses the form of a spherical cap which is smaller than a hemisphere and, on the side facing away from the nozzle core, possesses, after the spherical cap, a discontinuous transition.

Especially preferably, the method involves the exchange of at least two nozzle cores with different lengths which can be received by the housing. These are exchanged for the purpose of setting the distance of the breakaway edge of the baffle body from the plane defined by the outlet orifice.

This method regarding the use of a baffle body in the texturing process is preferably carried out by means of the above-described texturing device according to claims 13 to 17.

Figure 1B:
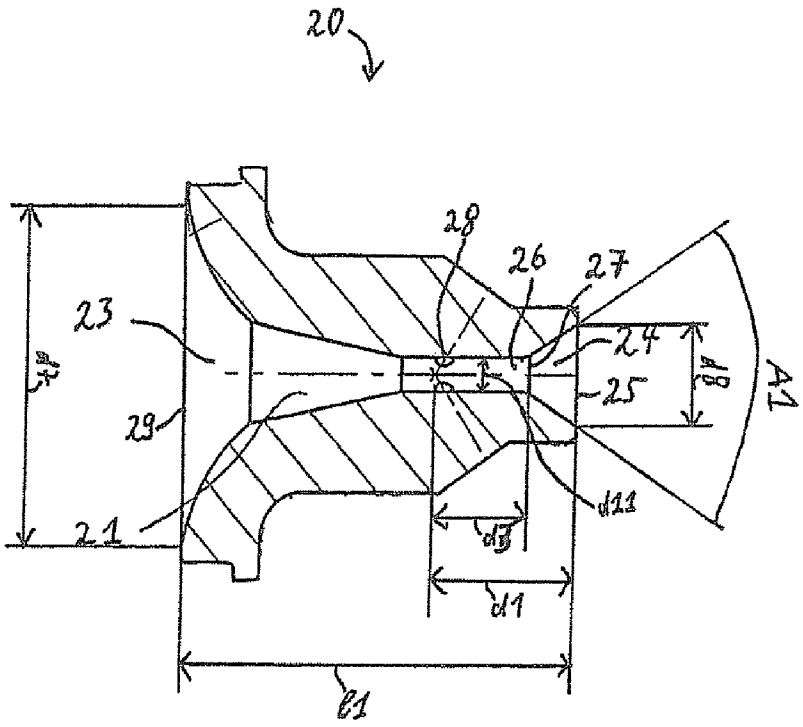
Figure 1C:
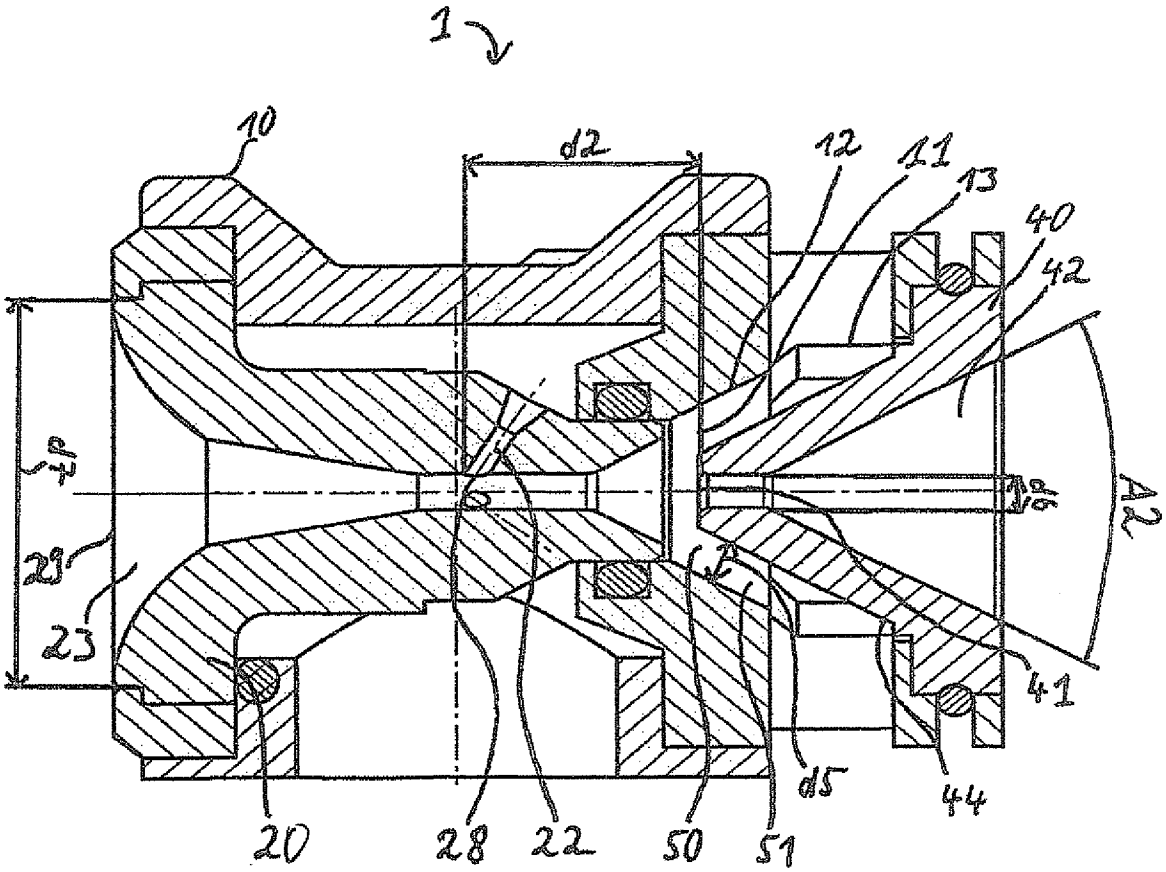
Figure 2:
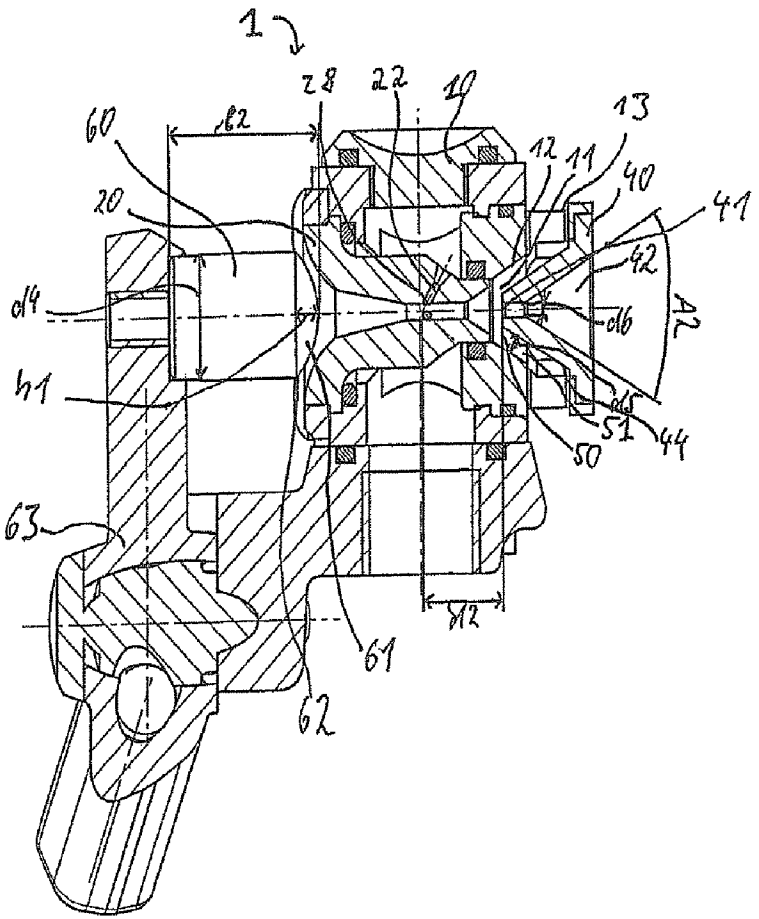
Figure 3:
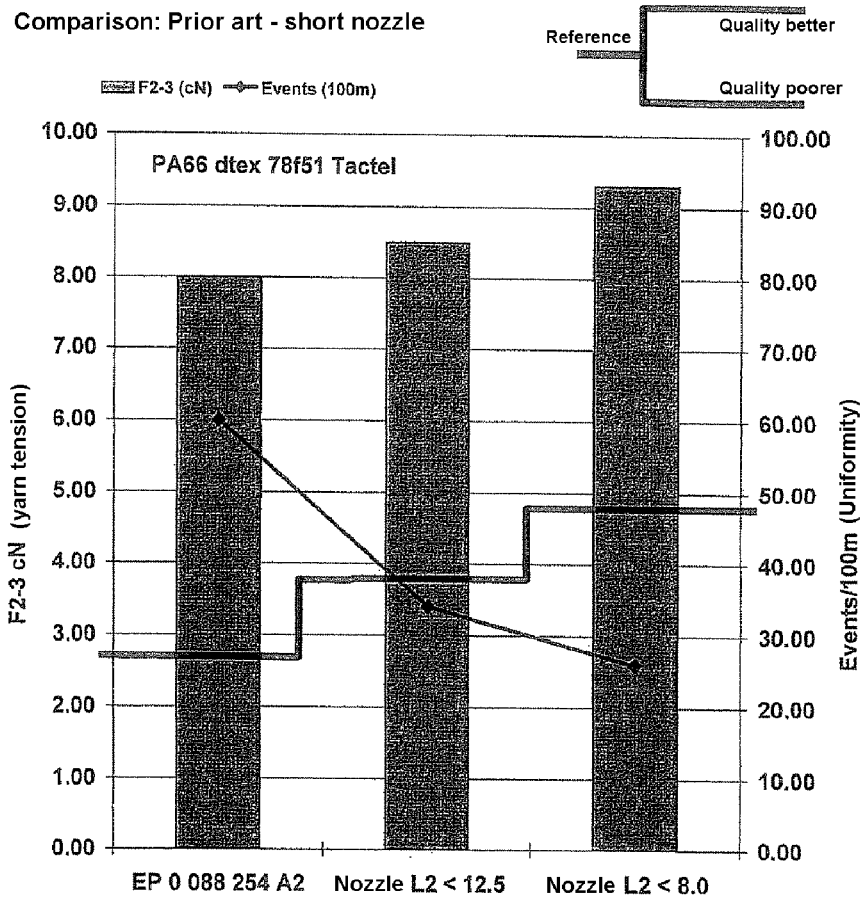
Figure 4:
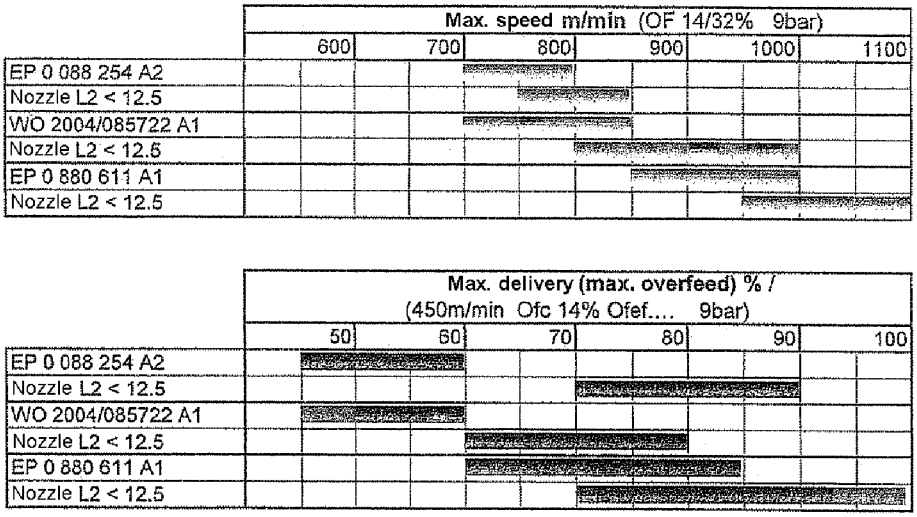
Figure 5:
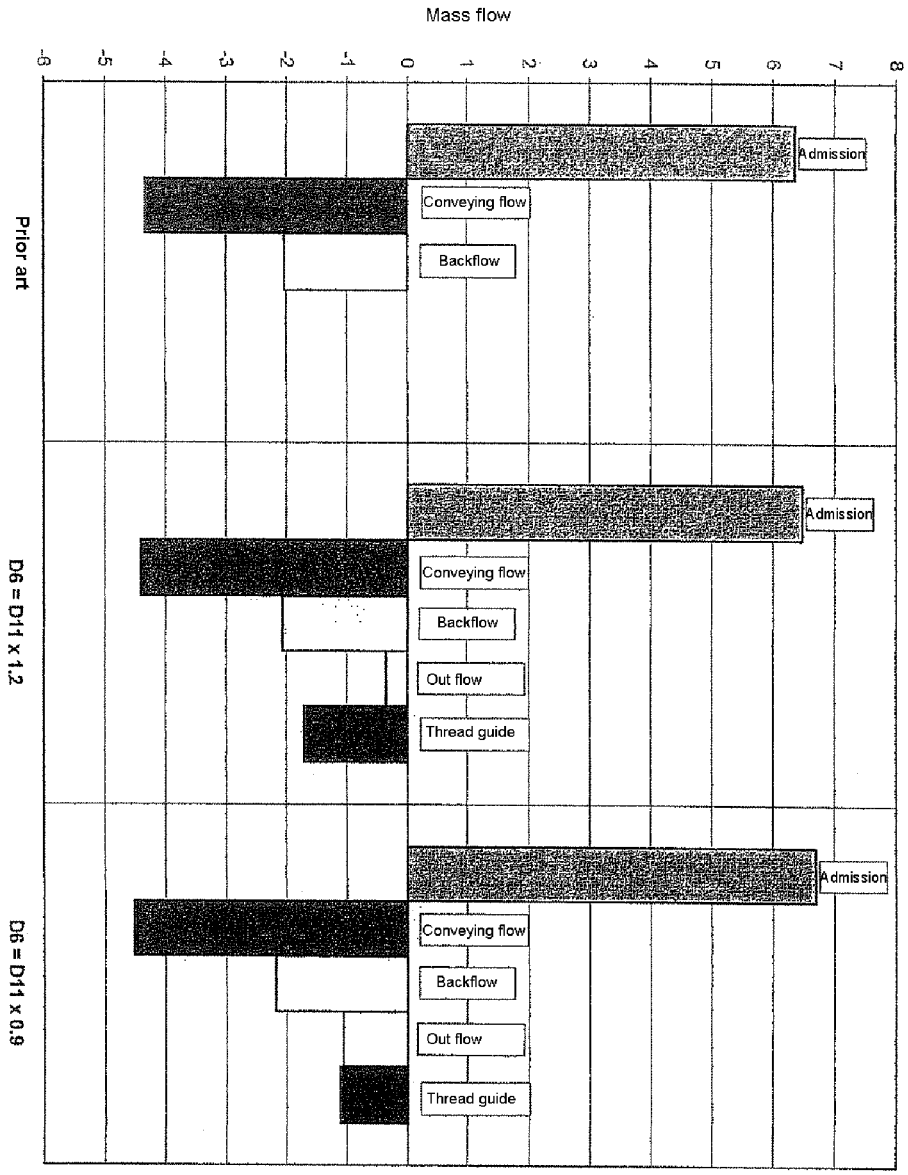
Figure 6:
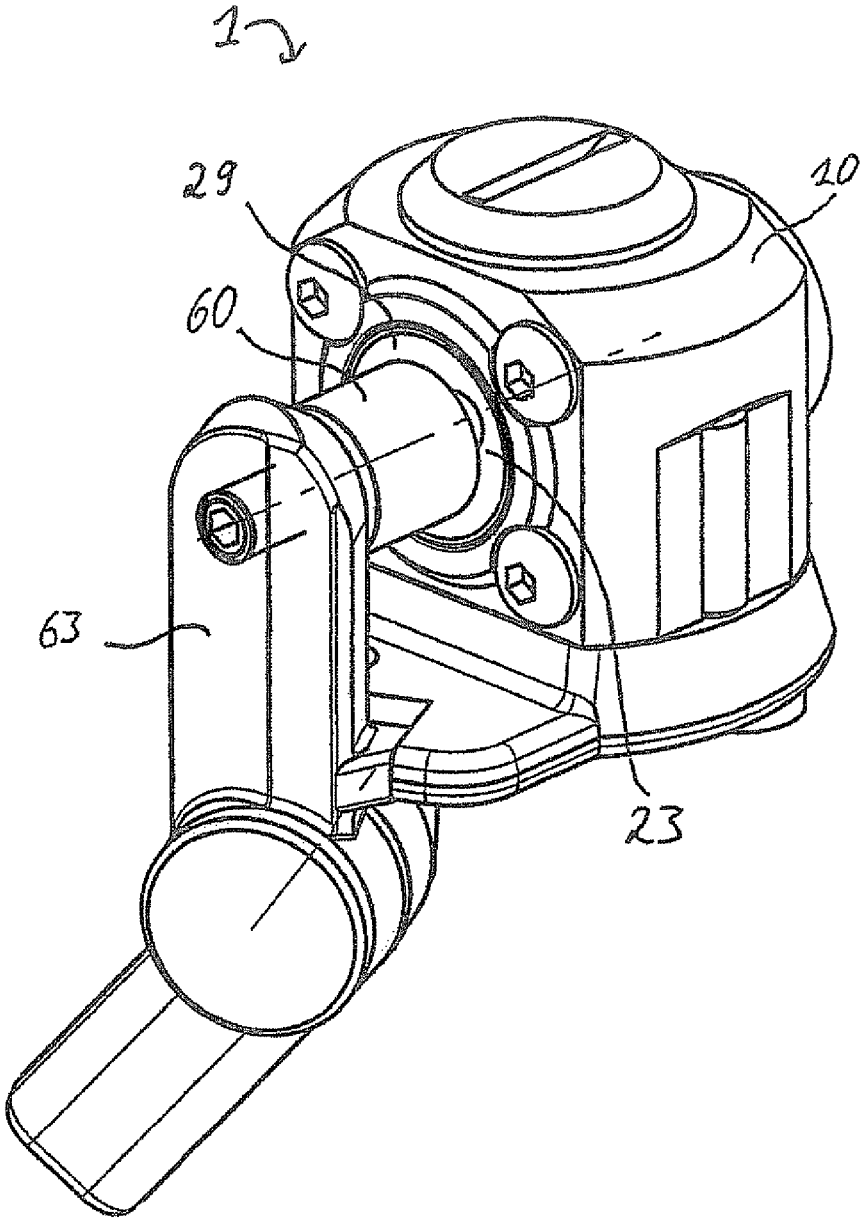
Figure 7:
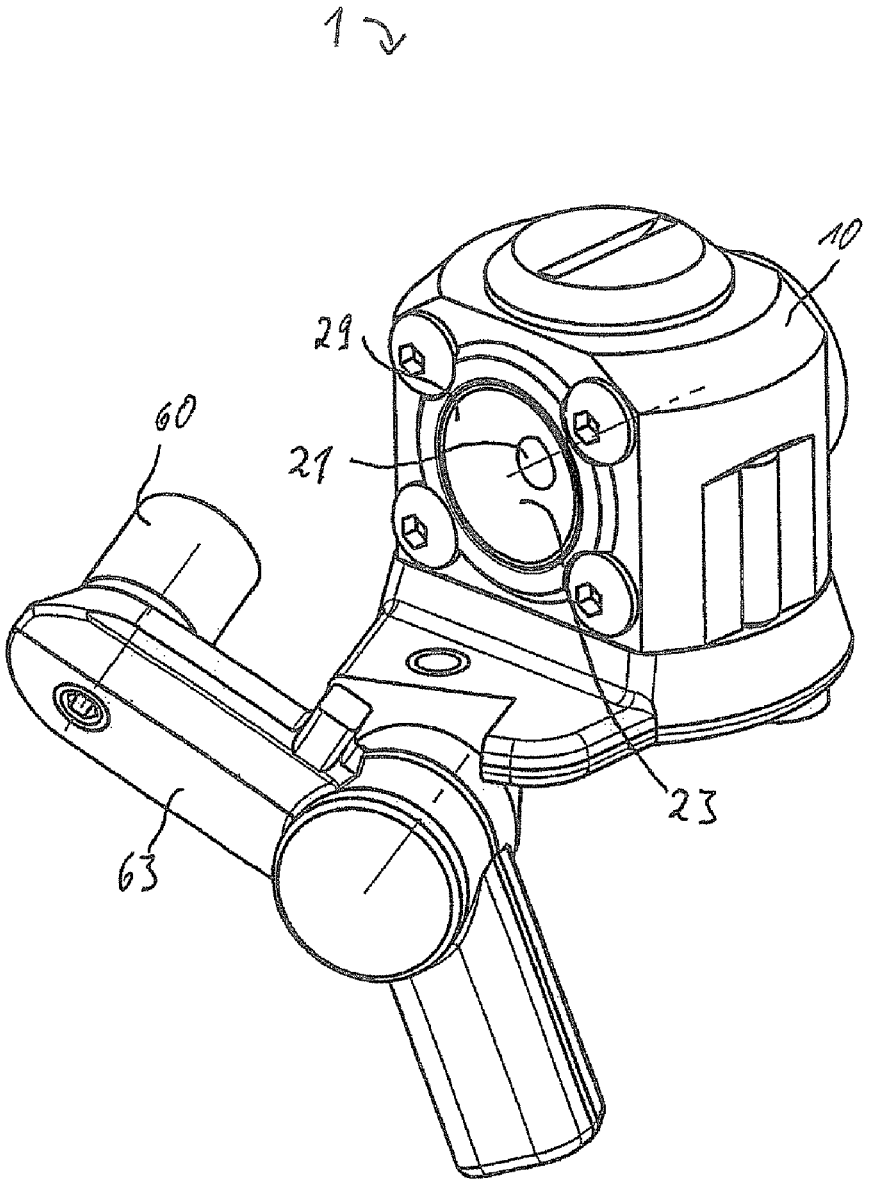
Figure 8:
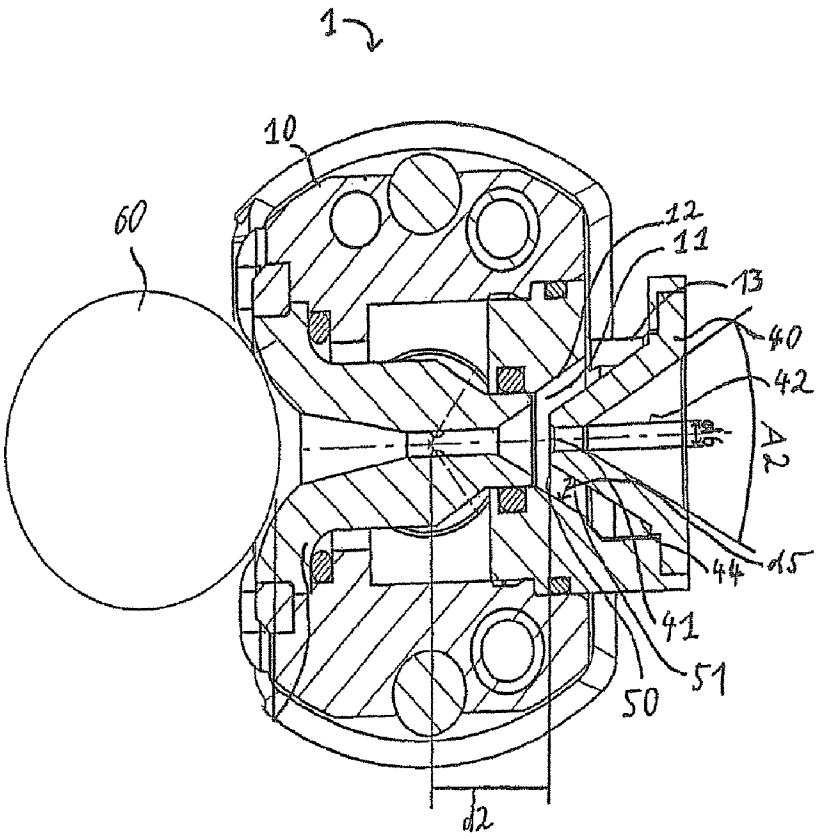
Figure 3:
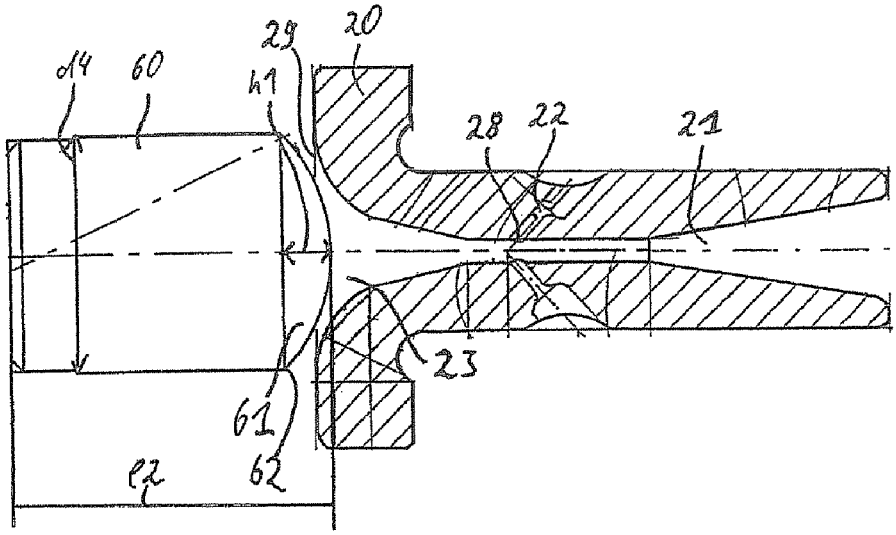
Figure 10:
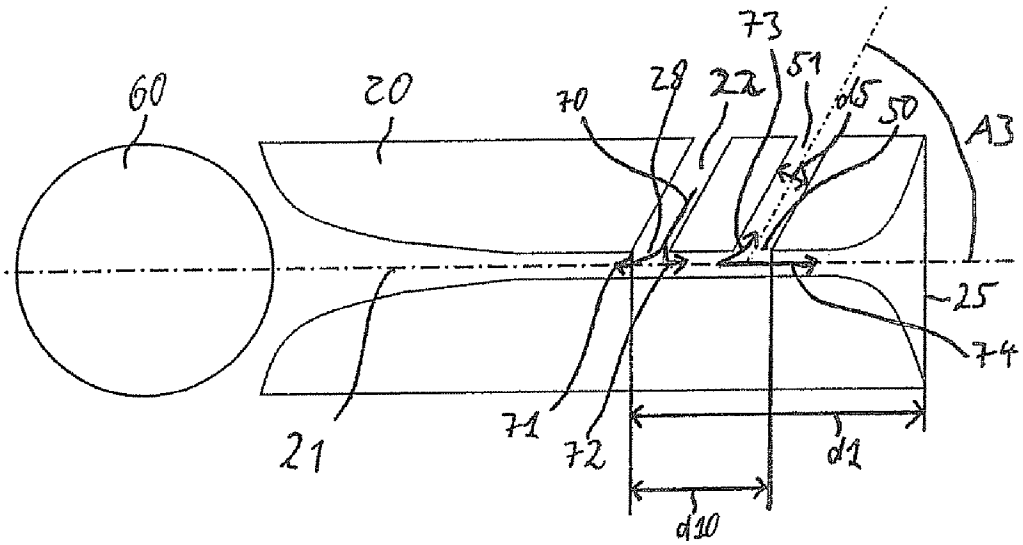
Figure 11:
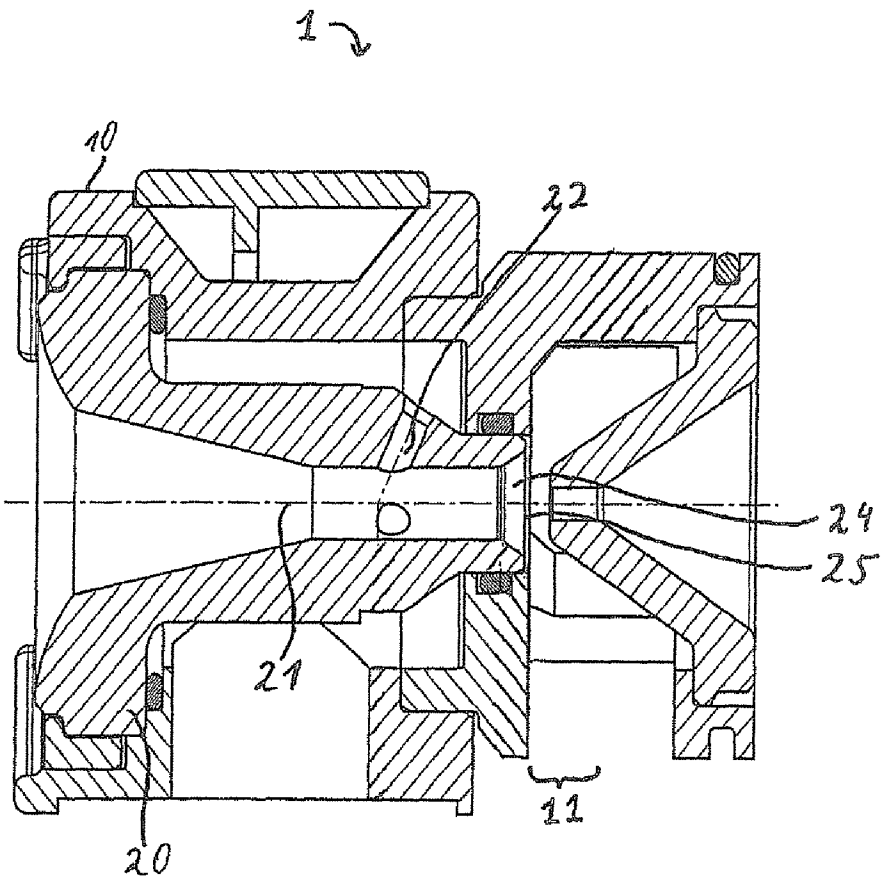

The invention is explained below, for clearer understanding, by means of exemplary embodiments and drawings in which:

FIG. 1*a*: shows a section through a first plane along the axis of a yarn duct of a texturing device according to the invention FIG. 1*b*: shows a section through a plane along the axis of a yarn duct of a nozzle core according to the invention FIG. 1*c*: shows a section through a plane along the axis of a yarn duct of a further embodiment of a texturing device according to the invention FIG. 2: shows a section through a second plane along the axis of a yarn duct of a texturing device according to the invention FIG. 3: shows a comparison of the yarn quality achievable by means of a texturing device according to the invention with respect to the prior art FIG. 4: shows a comparison of the production speed achievable and delivery achievable by means of a texturing device according to the invention with respect to the prior art FIG. 5: shows a comparison of the flow conditions in a texturing device according to the invention with respect to the prior art FIG. 6: shows a perspective illustration of the texturing device according to the invention FIG. 7: shows a perspective illustration of the texturing device according to the invention with a swung-out baffle body FIG. 8: shows the set-up of a texturing device with a backflow orifice according to the invention in a first alternative embodiment FIG. 9: shows the set-up of a texturing device with a baffle body according to the invention in a second alternative embodiment FIG. 10: shows the set-up of a texturing device with a backflow orifice according to the invention in a further alternative embodiment FIG. 11: shows a section through a plane along the axis of a yarn duct of an additional embodiment of a texturing device according to the invention.

FIG. 1*a* shows a texturing device 1 according to the invention. An enlarged illustration of the nozzle core from FIG. 1*a* is shown in FIG. 1*b*.

The texturing device comprises a housing 10 with a rotationally symmetrical nozzle core 20. This nozzle core 20 is usually composed of ceramic or high-grade metals. The nozzle core 20 possesses a yarn duct 21 with a length 11 of 16 mm. The yarn duct 21 has an entry region 24 with an inlet orifice 25. This entry region 24 narrows conically at an angle A1 of 60°. The yarn duct 21 subsequently has, in the thread movement direction, an essentially cylindrical region 26 with a diameter d11 of 1.1 mm and with an orifice 28 for the fluid supply 22. The distance d3 between the inlet orifice 27 into the cylindrical region 26 and the inlet orifice 28 of the fluid supply duct 22 amounts to 4 mm. The distance d1 between the inlet orifice 28 and the inlet orifice 25 amounts to 6 mm. That region of the yarn duct 21 which follows in the thread movement direction widens to the diameter d7 of 12 mm of the outlet orifice 29. In this widening region, the flow is accelerated to a velocity such that the texturing of the continuous yarn can take place. Located upstream of the entry region 24 of the nozzle core 20 is a region 11 which is delimited by the housing 10 and which narrows conically at an angle of 60°. No parts of the housing 10 are located inside the region 11.

A thread guide 40 is mounted upstream of the inlet orifice 25, so that it is partially introduced into the region 11 and a gap with the diameter d5 is formed between the outer periphery 12 of the entry region 11 and the outer periphery 44 of the thread guide. This gap with the diameter d5 forms a backflow orifice 50. The cross-sectional area of this backflow orifice 50 should be set such that it is larger than the cross-sectional area of the cylindrical region 26. The cross-sectional area of the backflow orifice 50 can be set by varying the distance d2 between the inlet orifice 28 and the thread guide exit 41. The distance d2 amounts here to 7 mm.

The thread guide 40 possess a yarn duct 42 which narrows conically at an angle A2 of 60° to the eye diameter d6 of 1 mm. That side of the thread guide 40 which faces the nozzle core possesses a thread guide exit 41.

A baffle body 60 with a length 12 of 12 mm and with a diameter d4 of 9 mm is fastened in a baffle body holder 63. This baffle body holder 63 is located downstream of the exit region 23 of the nozzle core in the thread movement direction. The baffle body holder 63 is configured structurally such that the baffle body 60 can be swung out. It is possible, for example, to pivot the baffle body 60 into an operating position, that is to say the axis parallel to the length 12 is parallel to the axis of the yarn duct 21 of the nozzle body 20. A further possible position of the baffle body 60 is, for example, a swung-out position. This allows better access to the nozzle body 20, for example for cleaning purposes or to exchange the nozzle body 20.

The baffle body 60 is designed, on the side facing the outlet orifice 29, as a spherical cap 61 with a height h1 of 1.9 mm and has a breakaway edge 62. This breakaway edge 62 is at a distance d9 of 0.7 mm from the outlet orifice 29.

FIG. 1*c* shows a further embodiment of a texturing device 1 according to the invention. This shows, in contrast to FIG. 1*a*, a nozzle core 20 which is pressed into the housing 10 and is therefore no longer interchangeable.

FIG. 2 shows an alternative section through the texturing device 1 which is described in FIG. 1. The fluid supply duct 22 with the inlet orifice 28 can be seen more clearly in this illustration.

The housing 10 which receives the nozzle core 20 is constructed in such a way that a connection for a fluid supply on the housing 10 is connected to the fluid supply duct 22, so that the nozzle core 20 can be fed with a fluid via the fluid supply duct 22. Alternatively, the housing may allow the direct connection of a fluid supply to the fluid supply duct 22, so that the nozzle core 20 can be fed with a fluid.

The details of this refinement are not disclosed here.

FIG. 3 shows comparative tests for the achievable yarn quality of various texturing devices 1 according to the invention with respect to a texturing device T311 which corresponds to the prior art according to EP 0 088 254 A2.

These tests showed that use of the texturing device described in a texturing method achieves the following advantages:

- at a distance d1 of the fluid supply 22 from the inlet orifice 25 of 12.5 mm, a yarn tension, which is a measure of the quality of the continuous yarn, increases by approximately 6%, as compared with the prior art, for the continuous yarn PA66 dtex 78f51 Tactel. Moreover, the number of defects in the yarn per 100 m of continuous yarn decreases by 40%. The visually determined uniformity of the yarn, which is a further measure of quality, is likewise improved,
- at a distance d1 of 8 mm, yarn tension is increased by approximately 15%, as compared with the prior art, for the continuous yarn PA66 dtex 78f51 Tactel. Moreover, the number of defects in the yarn per 100 m of continuous yarn decreases by 60%. The visually determined uniformity of the yarn is likewise improved once again.

FIG. 4 shows comparative tests of the achievable production speed and achievable delivery by means of a texturing device 1 according to the invention with respect to the texturing devices T311 (according to EP 0 088 254 A2), A317 (according to WO 2004/085722 A1) and 5315 (according to EP 0 880 611 A1).

The maximum achievable speed at which the continuous yarn can be led through the texturing device 1 according to the invention is increased, according to the tests, by up to 18%, as compared with A317. The maximum achievable delivery by means of the texturing device 1 according to the invention is improved by up to 50%, as compared with T311.

FIG. 5 shows calculations of the mass flow in the texturing device 1 in comparison with the prior art according to A317.

Air, what is known as the admission, is supplied under excess pressure to the yarn duct 21 of the nozzle body 20 by the fluid supply 22. This mass flow is divided into a component in the thread movement direction, the conveying flow, and into a component opposite to the thread movement direction, the backflow. This backflow can be divided into an outflow through the backflow orifice 50 and the backflow duct 51 and a flow through the thread guide exit 41.

In the prior art, the entire backflow acts as flow resistance upon the filaments. By means of the texturing device 1 according to the invention with the backflow orifice 50, part of the backflow is discharged via the backflow orifice 50. This results in the advantages, already described, of the structural configuration of the texturing device 1 with a backflow duct 51.

The calculations show that the eye diameter d6 should preferably be smaller that the diameter d11 of the cylindrical region 26 and the yarn duct 21. The smaller the eye diameter d6 is in relation to the diameter d11 of the cylindrical region 26, the larger is the fraction of the backflow which is discharged via the backflow duct 51.

FIG. 6 shows a perspective illustration of the texturing device 1, as described in FIG. 1. Here, the baffle body 60 is swung out, for example in order to thread in the continuous yarn or to clean the texturing device. The housing 10 and the exit region 23 with the outlet orifice 29 can be seen in this illustration. Moreover, the rotationally symmetrical character in relation to the yarn duct axis of the exit region 23 and of the yarn duct 21 can be recognized.

FIG. 7 shows a further perspective illustration of the texturing device 1, as described in FIG. 1. Here, the baffle body 60 is in a position which it assumes, for example, during operation.

FIG. 8 shows a texturing device 1 according to the invention with a housing 10, with a nozzle core 50 and with a thread guide 40, as described in FIG. 1. In contrast to FIG. 1, here the textured continuous yarn is discharged, after the texturing operation, via a spherical baffle body 60 without a breakaway edge. The baffle body holder 63 is not shown.

FIG. 9 shows a detail of a texturing device 1 according to the invention with a nozzle core 20. The construction of the yarn duct 21 of the nozzle core 20 corresponds to the prior art according to EP 0 880 611. The discharge of the textured continuous yarn takes place here via a baffle body 60 according to the invention having a breakaway edge 61. This leads to minimizing the susceptibility of the texturing device to soiling, but not to any increase in production speed.

FIG. 10 shows diagrammatically a nozzle core 20 with a construction of the yarn duct 21 corresponding to the prior art according to EP 0 880 611 A1. The fluid is supplied to the yarn duct 21 via the fluid supply duct 22 with the inlet orifice 28. In contrast to the prior art, here, a duct functioning as a backflow duct 51 is present between the inlet orifice 25 and the fluid supply duct 22 for the fluid with the inlet orifice 28. The distance d10 of the backflow orifice 50 from the inlet orifice 28 is preferably smaller than 14 mm. The angle A3 between the axis of the backflow duct 51 and the axis of the yarn duct 21 points opposite to the thread movement direction and lies between 15° and 80°.

The fluid 70 is supplied via the fluid supply duct 22. In the yarn duct 21, a flow is divided into a part with a component in the thread movement direction, the conveying flow 71, and into a component opposite to the thread movement direction, the backflow 72. The backflow 72 is divided into an outflow 73 through the backflow orifice 50 and an outflow 74 through the inlet orifice 25 of the yarn duct 21. This division causes the flow with the component opposite to the thread movement direction to be partially discharged via the backflow orifice 50 and the backflow duct 51. Here, too, the separate discharge of part of the backflow through the backflow duct 51 has the effect that the production speed can be increased and the quality of the textured continuous yarn is enhanced.

The baffle body 60 corresponds to the prior art and possesses no breakaway edge.

FIG. 11 shows an additional embodiment of a texturing device 1 according to the invention. A housing 10 receives the nozzle core 20. The nozzle core 20 has a yarn duct 21 which corresponds to the yarn duct 21 illustrated in FIG. 1*b*, with a fluid supply 22. A region 11 is located upstream of an entry region 24 with an inlet orifice 25 in the thread movement direction.

Here, for example in contrast to FIG. 1*a*, the region 11 has no outer periphery which is formed by the housing and which narrows conically. Upstream of the entry region 24 of the nozzle core 20 in the thread movement direction, the region 11 has an extent parallel to the axis of the yarn duct of 2.9 mm.

The invention claimed is:

1. A texturing device for texturing at least one continuous yarn composed of a plurality of filaments, containing at least one housing and at least one nozzle core, the nozzle core being capable of being fed and having a yarn duct, at least one fluid supply duct issuing with a radial component into the yarn duct, an exit region of the yarn duct an entry region with an inlet orifice of the yarn duct, and an upstream region located upstream of the entry region, wherein the distance between the inlet orifice of the entry region and the fluid supply duct, issuing into the yarn duct, of the nozzle core amounts to at most 12.5 mm, and the upstream region is delimited by a radial outer periphery which lies outside a cone of 20° narrowing in the thread movement direction.

2. The texturing device as claimed in claim 1, wherein the upstream region which is located upstream of the entry region of the nozzle core in the thread movement direction extends parallel to the axis of the yarn duct at most 5 mm.

3. The texturing device as claimed in claim 1, wherein the nozzle core has an essentially cylindrical region with a length of at most 6 mm between the inlet orifice of the cylindrical region and the inlet orifice of the fluid supply duct issuing into the yarn duct.

4. The texturing device as claimed in claim 1, wherein the yarn duct of the nozzle core narrows in the thread movement direction in the entry region, with a conical narrowing which forms an opening angle of between 30° and 120°.

5. The texturing device as claimed in claim 1, wherein a thread guide for guiding the filaments is arranged upstream of the inlet orifice of the nozzle core in the thread movement direction.

6. The texturing device as claimed in claim 1, wherein a thread guide exit and the inlet orifice of the fluid supply duct are spaced apart.

7. The texturing device as claimed in claim 6, wherein the distance between the thread guide exit and the inlet orifice of the fluid supply duct amounts to at most 14 mm.

8. The texturing device as claimed in claim 5, wherein the thread guide has a yarn duct which narrows in the thread movement direction from the diameter of the inlet orifice of the thread guide to an eye diameter of the thread guide.

9. The texturing device as claimed in claim 6, wherein the thread guide has a yarn duct which narrows in the thread movement direction from the diameter of the inlet orifice of the thread guide to an eye diameter of the thread guide.

10. The texturing device as claimed in claim 9, wherein the narrowing of the yarn duct of said thread guide is conical and forms an angle of between 30° and 120°.

11. The texturing device as claimed in claim 5, wherein a thread guide is arranged in such a way that a gap is formed in the entry region between the thread guide and the housing with the nozzle core.

12. The texturing device as claimed in claim 8, wherein the eye diameter of the thread guide is smaller than the smallest diameter of the nozzle core.

13. The texturing device as claimed in claim 1, wherein the nozzle core can be connected interchangeably to the housing.

14. The texturing device as claimed in claim 1, wherein the nozzle core is not connectable interchangeably to the housing.

15. The texturing device as claimed in claim 1, characterized in that the outer periphery of the upstream region upstream of the entry region lies outside a cone of 30°.

16. The texturing device as claimed in claim 2, wherein said extent is at most 4 mm.

17. The texturing device as claimed in claim 2, wherein said extent is at most 3 mm.

18. The texturing device as claimed in claim 1, wherein said periphery lies outside a cone of 30°.

19. The texturing device as claimed in claim 4, characterized in that the yarn duct narrows with a conical narrowing which forms an opening angle.

20. The texturing device as claimed in claim 9, wherein the eye diameter of the thread guide is smaller than the smallest diameter of the nozzle core.

21. A method for texturing at least one continuous yarn comprising a plurality of filaments, by means of a texturing device, comprising steps of:

providing a texturing device containing at least one nozzle core being capable of being fed and having a yarn duct, at least one fluid supply duct issuing with a radial component into the yarn duct, an exit region of the yarn duct and an entry region with an inlet orifice of the yarn duct, supplying of a continuous yarn via the entry region, feeding of the texturing device with a fluid via the fluid supply duct, and discharging of the textured yarn at the yarn duct exit region, wherein said continuous yarn is led first through a region of the texturing device having a radial outer periphery which lies outside a cone of 20° narrowing in the thread movement direction, and subsequently is led through a region between the inlet orifice of the nozzle core and the inlet orifice of the fluid supply duct into the yarn duct of the texturing device, which region has a length of at most 12.5 mm.

22. The method as claimed in claim 21, wherein said continuous yarn is led first through a region of the texturing device having a radial outer periphery which lies outside a cone of 30°.

* * * * *